United States Patent [19]

Baumgarte et al.

[11] Patent Number: 4,931,065

[45] Date of Patent: Jun. 5, 1990

[54] AFTERTREATMENT OF REACTIVE DYEINGS ON CELLULOSE FIBERS

[75] Inventors: Ulrich Baumgarte, Limburgerhof; Rolf Fikentscher; Sigismund Heimann, both of Ludwigshafen; Heinrich Mertens, Frankenthal; Siegfried Schneider, Ludwigshafen; Michele Vescia, Limburgerhof, all of Fed. Rep. of Germany

[73] Assignee: BASF Aktiengesellschaft, Ludwigshafen, Fed. Rep. of Germany

[21] Appl. No.: 921,111

[22] Filed: Oct. 21, 1986

[30] Foreign Application Priority Data

Oct. 22, 1985 [DE] Fed. Rep. of Germany ..... 3537458

[51] Int. Cl.[5] ..... D06M 13/34

[52] U.S. Cl. ..... 8/188; 8/547

[58] Field of Search ..... 8/188, 547, 544, 137; 252/8.8; 525/546, 547, 528, 540, 523; 528/405

[56] References Cited

U.S. PATENT DOCUMENTS 4,615,709 10/1986 Nakao ..... 8/599

4,645,511 2/1987 Heller et al. ..... 8/549

FOREIGN PATENT DOCUMENTS 1396195 6/1975 United Kingdom .

2006279 10/1977 United Kingdom .

OTHER PUBLICATIONS

Chemical Abstracts, vol. 93, No. 20, Oct. 1980, p. 68, #151,593s.

Chemical Abstracts, vol. 86, No. 12, Mar. 1977, p. 86, #74,335k.

Chemical Abstracts, vol. 104, No. 4, Jan. 1986, p. 62, #20689a.

*Primary Examiner*—Paul Lieberman

*Assistant Examiner*—John F. McNally

*Attorney, Agent, or Firm*—Oblon, Fisher, Spivak, McClelland & Maier

[57] ABSTRACT

Reactive dyeings on textile materials containing cellulose fibers are aftertreated with aqueous solutions of benzylated resins which are obtainable (a) by condensation of methylamine and epichlorohydrin or (b) by heating triethanolamine and/or triisopropanolamine in the presence of acidic catalysts and have been reacted with from 0.25 to 1 mole of benzyl chloride per mole of amine in the condensate.

The dyed textile materials aftertreated in this manner possess good wet fastness.

5 Claims, No Drawings

AFTERTREATMENT OF REACTIVE DYEINGS ON CELLULOSE FIBERS

Fiber materials which contain cellulose fibers and have been dyed with reactive dyes are in practice generally subjected to an alkaline boil wash in the presence of a surfactant in order to remove dye which has not been fixed on the fabric. This procedure gives dyed cellulose fiber materials which possess adequate fastness to laundering but unsatisfactory fastness to water, to plating and to perspiration.

German Laid-Open Application No. DOS 2,747,358 discloses a process for the aftertreatment of cellulose fiber materials which have been dyed with reactive dyes, in which the fiber materials are treated with an aqueous solution of polyamines, nylons, polyurethanes and/or polyureas containing secondary and/or tertiary amino groups. Although such an aftertreatment improves the wetfastness of reactive dyeings on cellulose, a further increase in the fastness of the aftertreated dyeings is desirable, particularly the lightfastness and fastness to dry rubbing.

It is an object of the present invention to provide a process for the aftertreatment of reactive dyeings on textile materials containing cellulose fibers, in which dyed textile materials are obtained which possess good wetfastness and whose lightfastness and fastness to crocking are in practice not inferior to a dyed material washed in a conventional manner.

We have found that this object is achieved, according to the invention, by a process for the aftertreatment of reactive dyeings on textile materials containing cellulose fibers, in which the dyed textile materials are rinsed with water, aftertreated with an aqueous solution of a cationic condensate at from 5° to 100° C. and then rinsed again with water, wherein the cationic condensate used is a water-soluble, quaternized resin which is obtainable (a) by condensation of methylamine and epichlorohydrin or (b) by heating triethanolamine and/or triisopropanolamine in the presence of an acidic catalyst, and has been reacted with from 0.25 to 1 mole of benzyl chloride per mole of amine in the condensate.

The textile materials containing cellulose fibers may be in the form of fibers, yarns, fabrics or other piece goods. The cellulose fibers are, for example, cotton, linen or rayon staple. The textile materials which are aftertreated according to the invention may consist solely of cellulose fibers or contain cellulose fibers as a blend with synthetic fibers, such as nylon, polyacrylonitrile or polyester fibers.

The cellulose fibers are dyed with the commercial reactive dyes in a conventional manner, for example at from 20° to 100° C. by the exhaustion method or at room temperature by the cold pad-batch method. After being dyed, the textile material is first rinsed with cold water, then washed once or twice with hot water (70° to 100° C.) and, if required, washed once again with water at from 60° to 80° C. Only then is the textile material containing cellulose fibers and dyed with the reactive dyes treated with the cationic benzylated resins in aqueous solution, these resins being used as the aftertreatment agent.

The cationic condensates used according to the invention are prepared by condensation of methylamine and epichlorohydrin in a molar ratio of from 1:0.8 to 1:1. The said condensation is known, and is carried out at from 30° to 90° C., preferably from 40° to 80° C. in aqueous or alcoholic solution, the solids content of the solution usually being from 20 to 60% by weight. Examples of suitable alcoholic solvents are ethylene glycol, propylene glycol, diglycol and/or neopentyl glycol. The condensation is effected at a pH of from 8 to 12, preferably from 8 to 9. To establish the pH during the condensation, bases, such as sodium hydroxide solution, potassium hydroxide solution, sodium carbonate, calcium oxide, calcium hydroxide, barium oxide or barium hydroxide, may be used. If methylamine is used in excess in the condensation, an alkaline pH results owing to the basicity of the methylamine. The condensation is continued until water-soluble products are formed which have a viscosity of not less than 300 mPa.s in 20% strength aqueous solution at 20° C.

The cationic condensates (b) used according to the invention, which are obtainable by heating triethanolamine and/or triisopropanolamine in the presence of an acidic catalyst at from 120° to 280° C., are likewise known compounds (cf. German Published Application Nos. DAS 1,127,084 and DAS 1,243,874). Examples of suitable acidic catalysts are formic acid, oxalic acid and the salts and esters of these acids, phosphorous acid and its ammonium and amine salts, halides, di- and triesters of phosphorous acid, amides of phosphorous acid, ester-amides and phosphonous acid and its halides, esters, amides and ester-amides. The condensation of triethanolamine, triisopropanolamine or mixtures of the stated compounds is preferably carried out in the presence of phosphorous or hypophosphorous acid. The acidic catalysts are used in an amount of from 0.1 to 1.0% by weight, based on the hydrdxyalkylamine to be condensed. This gives the condensates (b), which, when 100% pure, have a viscosity of not less than 40,000, preferably from 40,000 to 60,000, mPa.s at 20° C.

The water-soluble cationic condensates (a) and (b) described above are quaternized in a second reaction stage, from 0.25 to 1, preferably from 0.5 to 1, mole of benzyl chloride being used per mole of amine in the condensate (a) or (b). Quaternization is effected in an aqueous, preferably aqueous alcoholic, medium at from 60° to 100° C., but may also be carried out at higher temperatures, in which case the process has to be carried out under superatmospheric pressure. The conversion of the condensates (a) and (b) can be carried out in the presence of an alcohol as a solubilizer. The aqueous or alcoholic solutions of the benzylated condensates (a) and (b) can be used directly for the aftertreatment of reactive dyeings on textile materials containing cellulose fibers. The viscosity of the condensates (a) and (b) which have been reacted with benzyl chloride is not less than 6, preferably from 8 to 200, mPa.s in 20% strength aqueous solution at 20° C.

Aftertreatment of the cellulose fiber materials which may be present as a mixture with other fibers and are dyed with reactive dyes is carried out in an aqueous liquor containing the benzylated condensate (a) or (b), by a batchwise procedure in a dyeing apparatus, by a continuous procedure for card slivers in a lisseuse, or on a padding mangle or open-width washing machine for open-width goods. The batchwise aftertreatment of the dyed materials with the aqueous liquors generally takes from 5 to 30 minutes. The concentration of the water-soluble quaternary resins in the aftertreatment liquor is from 0.1 to 5, preferably from 0.25 to 2, g/l. The liquor ratio is from 1:5 to 1:50, preferably from 1:10 to 1:20.

The aftertreatment liquor has a pH of from 4 to 11, preferably from 5 to 8. However, the goods to be aftertreated can also be padded with the quaternized resins.

For padding, aqueous solutions of the benzylated resin in a concentration of from 1 to 50, preferably from 2.5 to 15, g/l are generally used.

Before the cellulose fiber materials dyed with reactive dyes are aftertreated with the benzylated cationic resins, they are rinsed thoroughly with water, advantageously first at least once with cold water and then at least once with water at from 70° to 100° C. The hydrolyzed reactive dyes washed out of the goods do not produce any precipitates in the presence of the products used according to the invention. If, on the other hand, condensates of dimethylamine and epichlorohydrin are used, troublesome precipitates are produced in the aftertreatment liquor.

The novel aftertreatment can be carried out at from 5° to 100° C., and, in a procedure similar to the exhaustion method, is preferably carried out at from 40° to 70° C. It is also possible to adopt a procedure in which the cellulose material dyed with the reactive dyes is first rinsed thoroughly with cold and hot water, then treated with the aqueous solution of the benzylated resin at a temperature close to the boiling point, and there-after rinsed with water. The textile material containing cellulose fibers and aftertreated according to the invention does not show any lightening of the color, so that no color shifts result even in the case of combination dyeings. This gives dyeings whose fastness to water meets the stringent requirements set for dyeings in industry. The novel aftertreatment produces virtually no deterioration in the lightfastness and fastness to crocking of the dyeings. Following the novel aftertreatment, the textile material containing cellulose fibers can be rinsed and then dried.

In the Examples, parts and percentages are by weight. The viscosities were measured in a rotary viscometer (Haake, Rotavisco). The following products were used as benzylated cationic resins:

RESIN 1 (CONDENSATE OF METHYLAMINE AND EPICHLOROHYDRIN)

606 g of a 40.9% strength aqueous methylamine solution (8 moles) are diluted with 636 g of water, and 333 g of epichlorohydrin (3.6 moles) and 288 g of 50% strength aqueous sodium hydroxide solution are added at from 20° to 40° C. in the course of 30 minutes, while cooling. As soon as the exothermic reaction has died down, a further 348 g of epichlorohydrin (3.76 moles) are added dropwise in the course of 30 minutes, the temperature being increased from 40° to 90° C. When the addition of epichlorohydrin is complete, the mixture is kept at 90° C. for 1 hour, 144 g of 50% strength sodium hydroxide solution are added and condensation is continued for 2 hours at 90° C. The mixture is then cooled to 40° C., and 810 g of water and 144 g of sodium hydroxide solution are added.

The resin has a viscosity of 350 mPa.s (20° C., $D_k$: 74 $s^{-1}$), a chloride content of 2.22 millimoles/g and a refractive index of $n_D^{20}$ of 1.393.

1620 g of diglycol and 65 g of 50% strength sodium hydroxide solution are added to 3300 g of this methylamine/epichlorohydrin condensate, the mixture is heated to 60°-70° C., 1008 g of benzyl chloride are added dropwise at this temperature in the course of 0.5 hour, and the mixture is then stirred for 3 hours at 80° C. The pH is brought to 4.0 with 53 g of 99% pure formic acid, diluted with 2459 g of diglycol and cooled to room temperature. The cationic resin has a chloride content of 1.83 millimoles/g, an acid number (alcoholic KOH) of 0.30 millimole/g, a viscosity (Haake Rotavisco) of 150 mPa.s measured at 20° C. ($D_k$: 26.4 $s^{-1}$), a refractive index of 1.4546 and a pH of 4.0.

RESIN 2 (CONDENSED TRIETHANOLAMINE)

1790 g of triethanolamine (12 moles) and 12 g of 50% strength aqueous hypophosphorous acid ($H_3PO_2$) are heated to 230° C. under nitrogen in a reaction vessel equipped with a stirrer and a distillation apparatus. With elimination of water, the viscosity of the reaction solution increases within 4-5 hours to 42,000-44,000 mPa.s measured at 20° C. in a plate and cone rotary viscometer; $D_k$ 12 $s^{-1}$. 1610 g of polyaminopolyether having an amine number of 7.44 millimoles/g are obtained.

2880 g of water are added to 1480 g of this triethanolamine polyether, the mixture is heated to 60°-70° C., and quaternization is then carried out in the course of 1 hour at 80° C. with 1386 g of benzyl chloride. The mixture is allowed to continue reacting for 3 hours at 80° C., after which it is cooled to room temperature. The chloride content of the solution is 1.92 millimoles/g and the viscosity (Rotavisco from Haake) is 140 mPa.s (20° C., $D_k$ 76.8 $s^{-1}$)

EXAMPLE 1

Cotton knitwear is dyed with 5%, based on the goods, of the orange reactive dye of Color Index No. 18,260 in a liquor ratio of 1:20 with a liquor which contains 60 g/l of sodium chloride, 9 g/l of sodium carbonate and 1 g/l of sodium bicarbonate in addition to the dye. After dyeing has been carried out for 30 minutes, the liquor is discharged, the material is rinsed in cold water in a liquor ratio of 1:20, the rinsing liquor is discharged and the material is then treated with water at 95° C. for 10 minutes. The water is again discharged and the dyed textile material is treated with an aqueous solution which contains 2 g/l of resin 1, this aftertreatment being carried out for 10 minutes at the boiling point. The pH of the liquor is brought to 5-6. After treatment for 10 minutes, the initially colorless liquor assumes a pronounced coloration. It is discharged, and the goods which have been aftertreated with it are rinsed thoroughly with cold water and then dried.

The dyeing obtained achieves a rating of from 4 to 5 for water fastness, severe (according to DIN 54,006, bleeding onto the undyed cotton fabric), which is 1.5 better than a dyeing aftertreated with a conventional anionic or nonionic washing agent. The water fastness, severe in this case is rated at 3.

The fastness to dry rubbing (according to DIN 54,021) and the lightfastness on exposure in the xenotest (DIN 54,004) are virtually unchanged for the material aftertreated according to the invention. Improvements similar to that obtained for the fastness to water are also obtained if the wet dyeing is plated to dryness between two pieces of cotton fabric in a standardized manner by the plating test described below.

PLATING TEST

In practice, the end point of a rinsing process in reactive dyeing is frequently checked by a procedure in which a piece of the dyed material which has not yet been dried is placed between two moistened pieces of white cotton fabric and this sandwich is plated to dryness.

This treatment causes the dyes which are not fixed to migrate from the dyed material to the white material. The test method is very sensitive since the smallest amounts of dyes which are not fixed soil the white material.

The dyeings are subjected to this plating test. The sandwiches are pressed twice in the plating machine (Siemens Heimbügler Spezial) for 30 seconds each time, at 180° C., and then dried in the running machine.

The results achieved are similar to those obtained in the case of water fastness, severe.

The same result is obtained if a cotton fabric is used instead of the knitwear.

EXAMPLE 2

Cotton knitwear is dyed as described in Example 1 and then rinsed with cold water and with hot water. The goods are then aftertreated with an aqueous solution which contains 2 g/l of resin 2 in solution. The aftertreatment is carried out at 100° C. in the course of 10 minutes, and the goods are then rinsed once with cold water and dried.

In the test for water fastness, severe (according to DIN 54,006, bleeding onto the undyed cotton fabric), a rating of from 4 to 5 is achieved.

EXAMPLE 3

Using the red dye of the formula

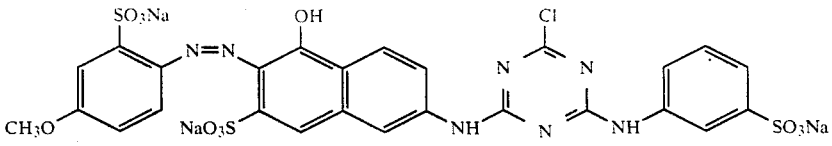

a 3% dyeing is produced on cotton knitwear by carrying out dyeing in a liquor ratio of 1:20 with a liquor which contains 60 g/l of sodium chloride and 20 g/l of sodium carbonate in addition to the stated dye. The goods are heated to 80° C. in the course of 40 minutes in this liquor, then kept at 80° C. for 60 minutes and then rinsed once with cold water and once with hot water, as described in Example 1. They are then aftertreated for 5 minutes at 100° C. with an aqueous solution of 1 g/l of resin 1. The resulting colored liquor is discharged, and the material is then rinsed with cold water and dried. A dyeing is obtained whose fastness to crocking and lightfastness are not inferior compared with a dyeing washed in a conventional manner. The heavy duty fastness to water (bleeding onto cotton fabric, according to DIN 54,006) is 4–5.

If the goods aftertreated according to the invention are stored for 3 days at 80° C. in an atmosphere saturated with moisture (test under tropical conditions), no deterioration in the water fastness, severe, is observed after this period.

EXAMPLE 4

In a hank dyeing apparatus, 80 kg of wet mercerized cotton yarn are dyed in 1000 l of dye liquor which contains 1.04 kg of the yellow reactive dye of the formula

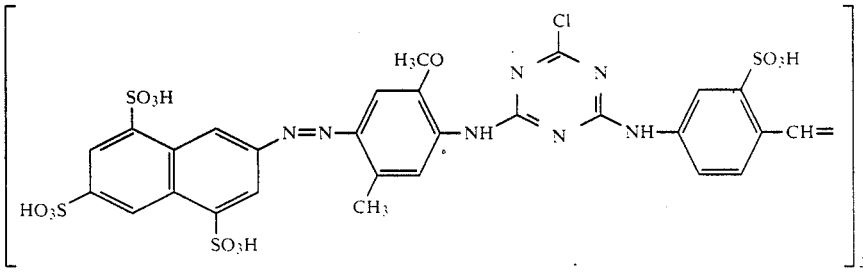

and 1.6 kg of the red reactive dye of the formula

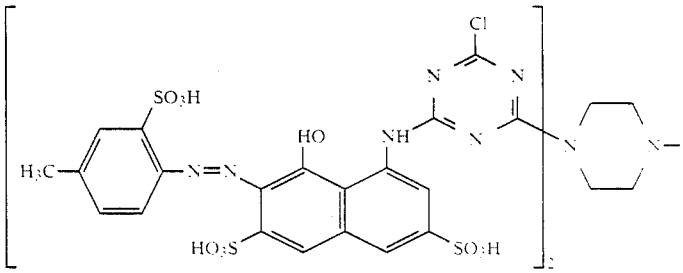

in a commercial formulation, the dyeing procedure being as described below.

The dyebath is heated to 95° C. in the course of 20 minutes. After a residence time of 10 minutes at this temperature, 30 kg of sodium chloride are added and the temperature is then kept at 95° C. for a further 5 minutes. The bath is cooled to 80° C. in the course of 10 minutes, after which 4 kg of sodium carbonate and 2 l of 44.8% strength aqueous sodium hydroxide solution are added.

The dyebath is then kept at 80° C. for 30 minutes, after which it is discharged. Rinsing is carried out for 10 minutes with cold water, with an overflow.

Thereafter, the goods are washed twice for 10 minutes at 98° C. and once for 10 minutes at 70° C.

The yarn is then divided into 3 parts:

a. One part of the dyed yarn is dried and then subjected to the plating test.

b. The second part of the dyed yarn is aftertreated for 20 minutes at 40° C. with an aqueous solution which contains 2%, based on the weight of the yarn, of resin 1 and has a pH of about 7.

c. The third part of the dyed yarn is aftertreated, according to German Laid-Open Application No. DOS 2,747,358, for 10 minutes at the boiling point, with an aqueous solution which contains 2%, based on the weight of the yarn, of a condensate of 1 mole of methyldipropylenetriamine and 0.87 mole of epichlorohydrin (21.9% strength) and has a pH of about 7.

The plating test shows that pronounced bleeding onto the undyed fabric takes place in the case of the untreated yarn (sample a). By means of treatment (c), bleeding can be reduced but not prevented. Only treatment (b) prevents bleeding onto the undyed fabric.

EXAMPLE 5

In an overflow dyeing apparatus, 75 kg of bleached cotton jersey are dyed in 1200 l of dye liquor which contains 2.475 kg of the yellowish red reactive dye of the formula

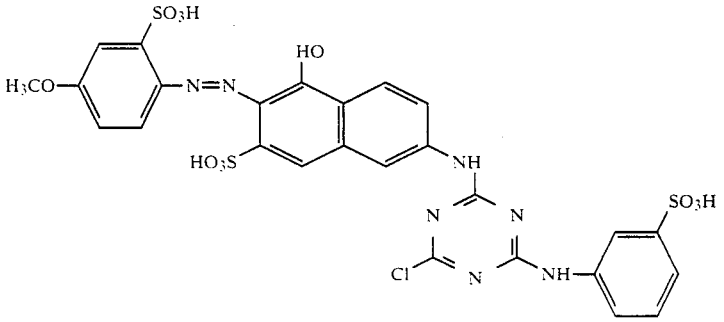

0.99 kg of the red reactive dye of the formula

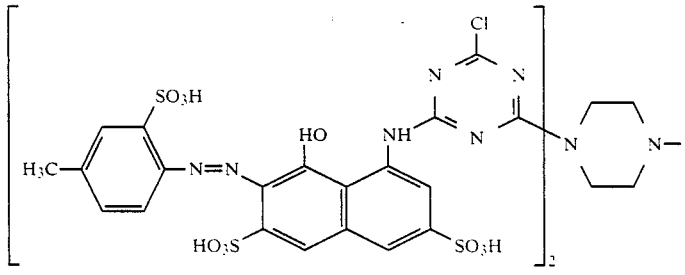

0.04 kg of the blue reactive dye of the formula

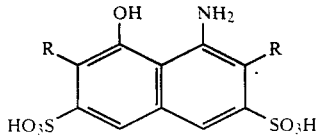

-continued

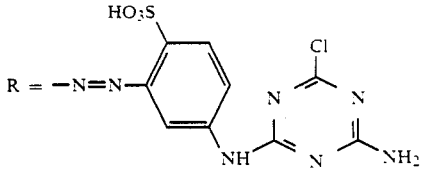

in each case in a commercial formulation, and 20 g/l of sodium carbonate and 80 g/l of sodium chloride, the dyeing procedure being as described below.

Dyeing is first carried out for 15 minutes at 25° C., and the dyebath is then heated to 50° C. in the course of 30 minutes and kept at this temperature for 20 minutes. Thereafter it is heated to 80° C. in the course of 30 minutes and dyeing is completed in the course of 45 minutes.

The goods are subjected to a cold rinse for 10 minutes, then rinsed twice at the boiling point for 10 minutes in each case and then rinsed once for 10 minutes at 50° C.

The goods are then aftertreated for 10 minutes at 60° C. with an aqueous solution which contains 1.5% of resin 2 and has a pH of about 7. In the subsequent plating test, no bleeding onto an undyed calico fabric takes place.

We claim:

1. A process for the aftertreatment of a reactive dyeing on a textile material containing cellulose fibers, in which the dyed textile material is rinsed with water, aftertreated with an aqueous solution of a cationic condensate at from 5° to 100° C. and then rinsed again with water, wherein the cationic condensate used is a water-soluble, quaternized resin which is obtainable (a) by condensation of methylamine and epichlorohydrin or (b) by heating triethanolamine and/or triisopropanolamine in the presence of an acidic catalyst and has been reacted with from 0.25 to 1 mole of benzyl chloride per mole of amine in the condensate.

2. A process as claimed in claim 1, wherein the water-soluble, benzylated resin used is obtainable by reacting the condensate (a) or (b) with from 0.5 to 1 mole of benzyl chloride per mole of amine in the condensate.

3. A process as claimed in claim 1, wherein the concentration of the water-soluble, benzylated resin in the aqueous solution is from 0.1 to 5 g/l and the liquor ratio is from 1:5 to 1:50.

4. A process as claimed in claim 1, wherein the water-soluble benzylated resin is applied onto the cellulose fiber material by padding with an aqueous solution which contains from 1 to 50 g/l of the resin.

5. A process as claimed in claim 1, wherein the dyed textile material is first rinsed at least once with cold water and then rinsed at least once with water at from 70° to 100° C., and the aftertreatment is then carried out at from 90° to 100° C.

* * * * *